US008869764B2

(12) United States Patent
Kretschmer et al.

(10) Patent No.: US 8,869,764 B2
(45) Date of Patent: Oct. 28, 2014

(54) VALVE DRIVE FOR AN INTERNAL COMBUSTION ENGINE

(75) Inventors: Juergen Kretschmer, Fuerth (DE); Wolfgang Christgen, Seukendorf (DE); Melanie Stark, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 77 days.

(21) Appl. No.: 13/553,185

(22) Filed: Jul. 19, 2012

(65) Prior Publication Data

US 2013/0025555 A1 Jan. 31, 2013

(30) Foreign Application Priority Data

Jul. 25, 2011 (DE) ..... 10 2011 079 748

(51) Int. Cl.

| | |
|---|---|
| ***F01L 1/14*** | (2006.01) |
| ***F01L 1/24*** | (2006.01) |
| ***F01L 1/18*** | (2006.01) |
| ***F01M 9/10*** | (2006.01) |

(52) U.S. Cl.

CPC ..... *F01L 1/185* (2013.01); *F01L 2810/02* (2013.01); *F01L 1/2405* (2013.01); *F01M 9/10* (2013.01)

USPC ..... 123/90.52; 123/90.33

(58) Field of Classification Search

USPC ..... 123/90.48, 90.52, 90.59, 90.39

See application file for complete search history.

(56) References Cited

U.S. PATENT DOCUMENTS

| | | | | |
|---|---|---|---|---|
| 4,200,081 | A * | 4/1980 | Meyer et al. | 123/198 F |
| 5,325,825 | A | 7/1994 | Schmidt et al. | |
| 2006/0090720 | A1 * | 5/2006 | Spath et al. | 123/90.48 |

FOREIGN PATENT DOCUMENTS

| | | |
|---|---|---|
| DE | 4234868 | 4/1994 |

* cited by examiner

*Primary Examiner* — Zelalem Eshete

(74) *Attorney, Agent, or Firm* — Simpson & Simpson, PLLC

(57) ABSTRACT

In a valve drive for an internal combustion engine, with a rocker arm (40) being arranged in its cylinder head pivotal by the cams of a camshaft and supported with one end at the valve shaft of a charge-cycle valve, while comprising at its other end a ball scraper (46), resting on the spherical end section (44) of a support element (42) embodied as a hydraulic valve clearance compensation element, a groove-shaped ventilation channel (57) is arranged according to the invention in the contact area between the ball scraper (46) of the rocker arm (40) and the spherical end section (44) of the support element (42) by which the oil reservoir (54) of the support element (42) is open towards the outside.

10 Claims, 3 Drawing Sheets

VALVE DRIVE FOR AN INTERNAL COMBUSTION ENGINE

CROSS-REFERENCE TO RELATED APPLICATIONS

This patent claims priority from German Patent Application No. DE 10 2011 079 748.3, filed Jul. 25, 2011, which application is incorporated herein by reference in its entirety.

FIELD OF THE INVENTION

The invention relates to a valve drive for an internal combustion engine, with a rocker arm being arranged in its cylinder head, which can be pivoted by the cam of a cam shaft and is supported at one end at the valve shaft of a charge-cycle valve while it comprises a ball scraper at its other end, which rests on the spherical end section of a support element embodied as a hydraulic valve clearance compensation element.

BACKGROUND OF THE INVENTION

A valve drive with a rocker arm of the type mentioned at the outset is known from the publication DE 42 34 868 A1. Here, the hydraulic valve clearance compensation element (hydraulic element) acting as a support element is installed in the cylinder head of the internal combustion engine and connected to its lubrication and hydraulic system. During operation of the internal combustion engine oil is ejected for lubrication and cooling via an oil ejection hole formed as a bore in the ball scraper of the rocker arm. Here, supported rotational at a rocker arm, a roller is lubricated and cooled, at which the cam rolls and here causes the deflection of the rocker arm.

Air is also inserted thereto, together with the oil to supply the hydraulic element, which can evacuate via the oil ejection hole. When in a valve drive an oil ejection hole is omitted in order to save and/or reduce the oil pumping performance and the lubrication and the cooling of the roller occurs in a different manner, depending on the design of the oil supply, a problem with noise may develop under certain operating conditions, e.g., in frequent motor starts or driving operation with very low average speeds. During start-up of the motor, the amount of air pumped together with the oil into the oil circuit and thus into the oil reservoir of the hydraulic valve clearance compensation element cannot evacuate quickly enough. Here, it is suctioned via the open return valve of the compensation element into its high-pressure chamber. This way, the compensation element becomes compressible, which leads to an elevated loss in stroke of the charge-cycle valve.

The closing speed of the valve increased here causes a noise, the so-called valve ticking. The leaking gap in the valve clearance compensation element between the top of the piston and the housing and/or the contact between the spherical end section of the support element and the ball scraper of the rocker arm prevent sufficient evacuation of air from the valve drive.

SUMMARY OF THE INVENTION

The invention is based on the objective to improve the valve drive such that during the pumping of oil into the valve clearance compensation element of the support element air entrained in the air can evacuate unhindered from the valve drive so that during operation the development of the valve ticking noise is avoided.

This objective is attained according to the invention such that in the contact area a groove-shaped ventilation channel is arranged between the ball scraper of the rocker arm and the spherical end section of the support element, via which the oil reservoir of the support element is opened towards the outside. This way, air entrained in the hydraulic oil of the valve clearance compensation element flows out of the oil reservoir, thus it is prevented from reaching the high-pressure chamber. The flow occurs through the ventilation channel according to the invention along the inner surface of the ball scraper of the rocker arm and the exterior surface of the spherical end section of the support element. Thus, the valve drive according to the invention can waive an additional opening of the ball scraper to evacuate air, as provided in the above-mentioned valve drive as an oil ejection hole.

The groove-shaped ventilation channel may be arranged in the ball scraper of the rocker arm or in the spherical end section of the support element. It is also possible to provide several ventilation channels in the contact area between the ball scraper and the end section, instead of only one ventilation channel.

BRIEF DESCRIPTION OF THE DRAWINGS

In the following, exemplary embodiments of the invention are shown in the drawing and shall be described in greater detail in reference to a valve drive according to prior art. It shows.

DETAILED DESCRIPTION OF THE DRAWINGS

Figure 3:
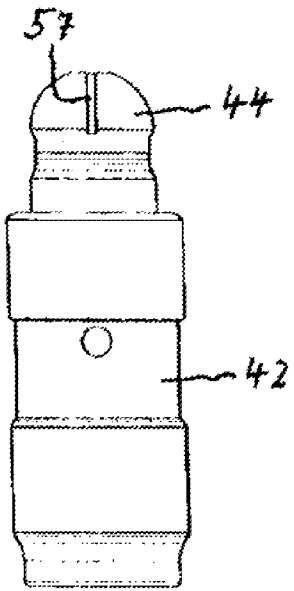
FIG. 3 the support element in a side view.
Figure 2:
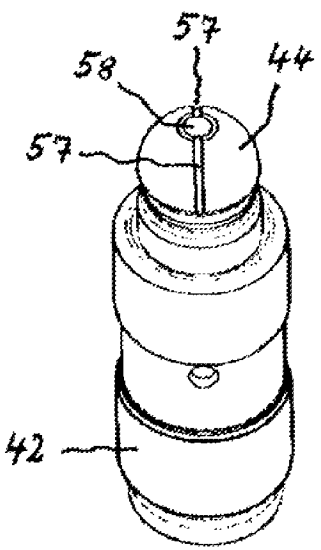
FIG. 2 the support element in a perspective view.
Figure 1:
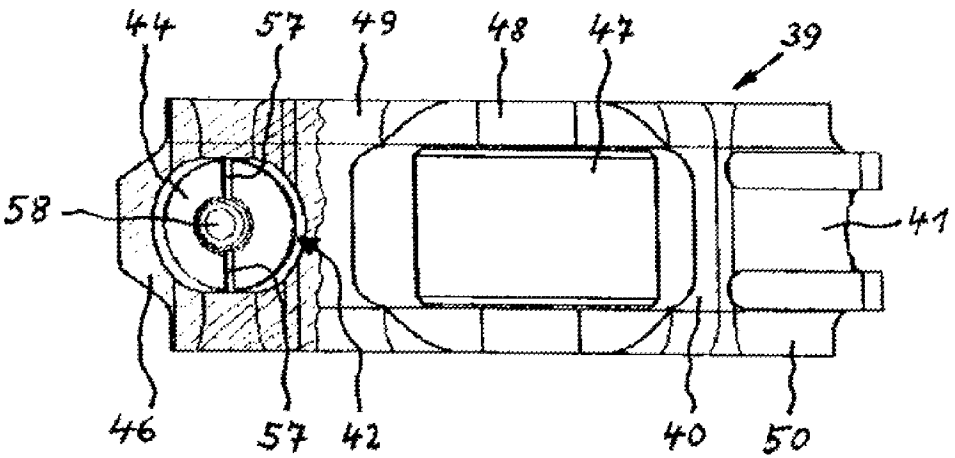
FIG. 1 a rocker arm with a support element according to the invention, partially in a side view and partially in a cross-section.
Figure 6:
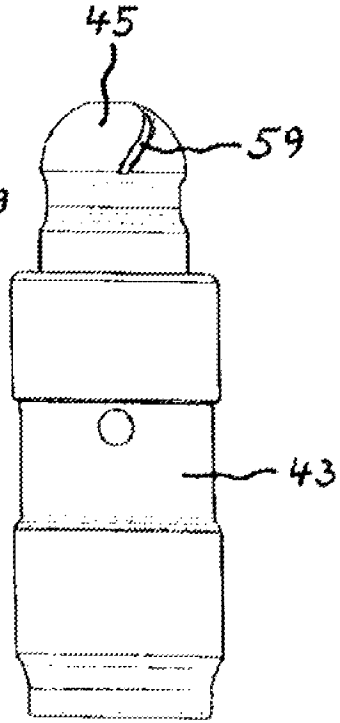
FIG. 6 the other support element in a side view.
Figure 5:
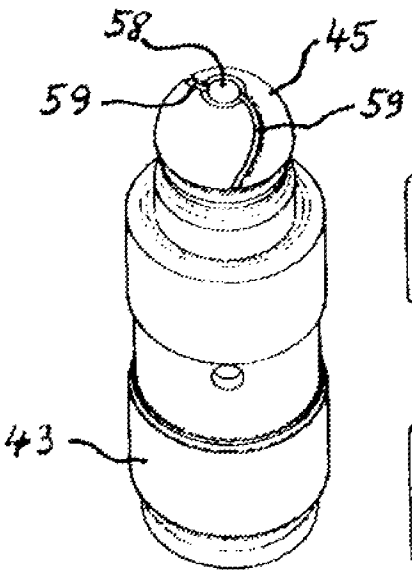
FIG. 5 another support element according to the invention in a perspective view.
Figure 4:
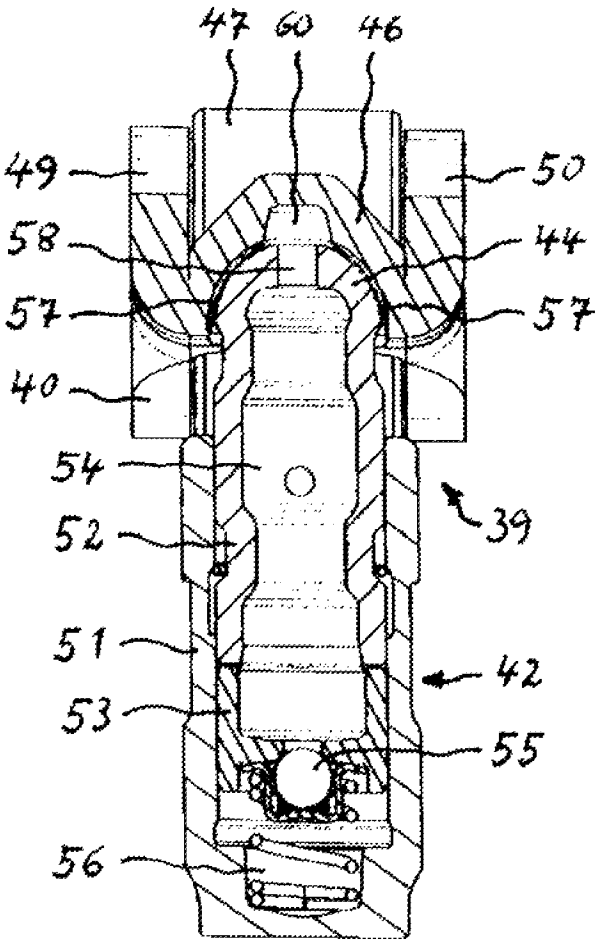
FIG. 4 the support element with the rocker arm resting thereupon in a longitudinal cross-section.
Figure 8:
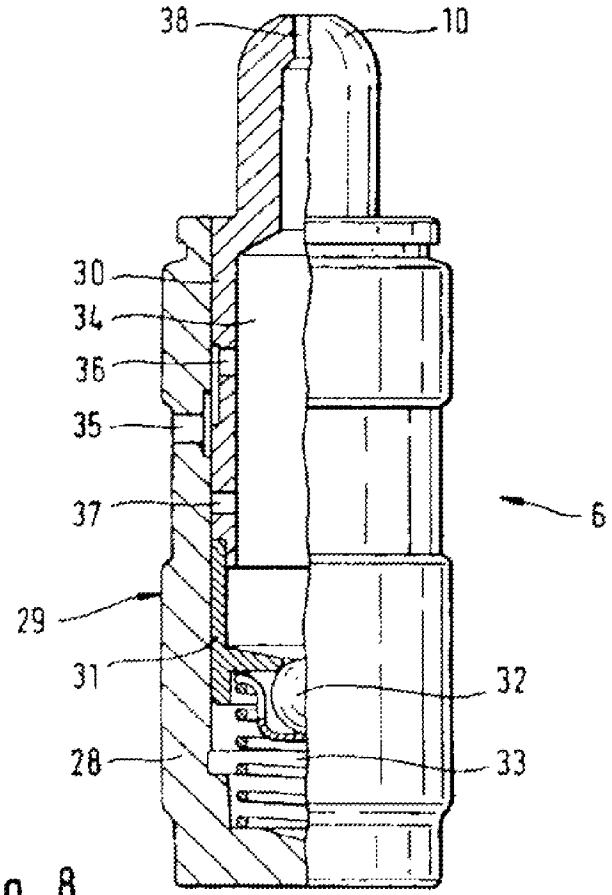
Fig. 8 PRIOR ART
FIG. 8 a support element of the above-mentioned valve drive, partially in a side view and partially in a longitudinal cross-section.
Figure 7:
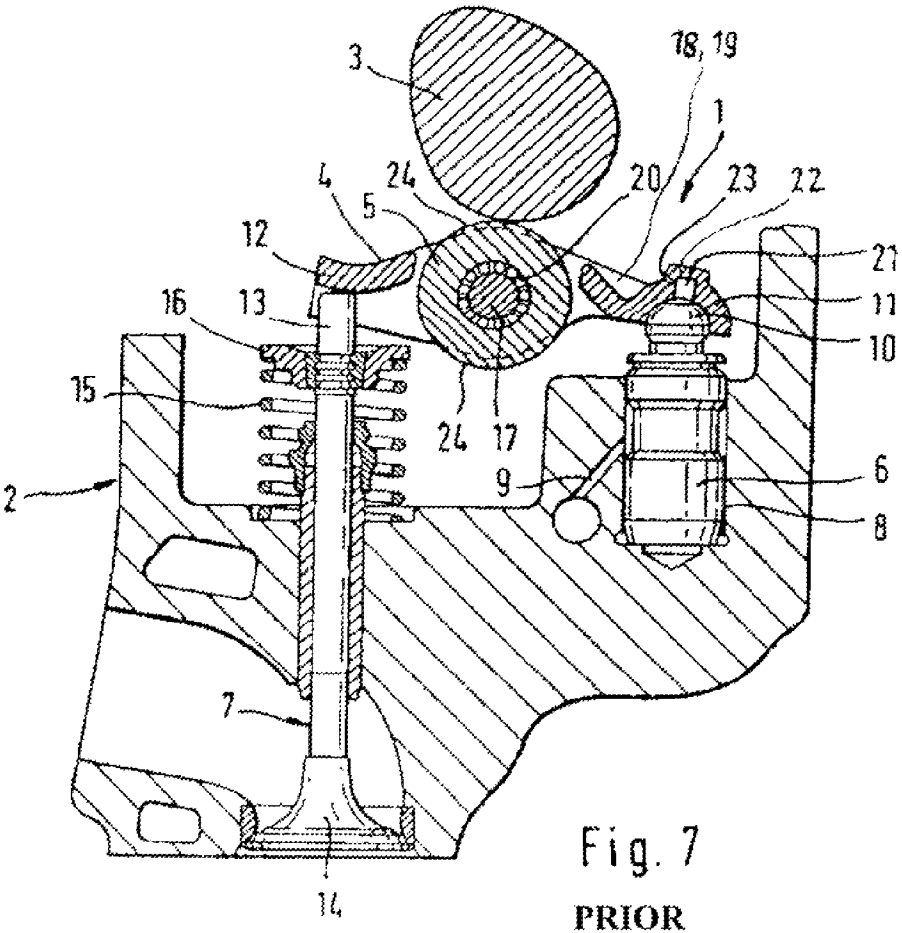
Fig. 7 PRIOR ART
FIG. 7 a valve drive of prior art in a longitudinal cross-section.

The valve drive 1 of a piston-internal combustion engine of prior art according to FIGS. 7 and 8 of the drawing is arranged in a cylinder 2, shown partially, and comprises the cam 3 of a cam shaft, not shown in greater detail, a rocker arm 4 with a roller 5, a support element 6, and a charge-cycle valve 7. The support element 6 is arranged in an accepting bore 8 of the cylinder head 2 and is supplied with oil via a pressure-means bore 9. Furthermore, the support element comprises a spherical end section 10, with a ball scraper 11 of the rocker arm 4 being supported thereon.

The rocker arm 4 may be produced as a formed sheet metal part, with it essentially showing a U-shaped cross-section. At its end 12, facing away from the ball scraper 11, the rocker arm 4 engages a valve shaft 13 of the charge-cycle valve 7. The charge-cycle valve comprises a valve plate 14 and is pre-stressed in the closed position by a valve spring 15, which is fixed in the axial direction by a spring plate 16 to the valve shaft 13. The roller 5 is guided via bolts 17 in the lateral walls 18, 19 of the rocker arm 4.

A needle bearing 20 serves for the rotary support of the roller 5 at the bolt 17, fastened in the lateral walls. During the rotation of the cam 3 the roller 5 rolls at the circumference of the cam.

A blind bore 21 is provided inside the ball scraper 11, with a dome 22 projecting beyond the exterior of the ball scraper. This dome is open towards the outside by a bore 23. By this bore acting as an oil ejection hole a fine beam of lubricant is applied at a tangential projection in reference to the roller 5 onto its running surface 24. A portion of the lubricant applied to the running surface reaches the faces of the roller 5 and therefrom into the needle bearing 20.

The support element 6 is shown in FIG. 8. It essentially comprises a housing 28 with a unit arranged therein and embodied displaceable in the longitudinal direction. The support element is embodied as a hydraulic valve clearance compensation element 29, in which the unit, guided in a longitudinally displaceable fashion, comprises a piston top 30 and a piston bottom 31. A ball valve 32 is arranged in the area of the lower face of the piston bottom 31. It seals a high-pressure chamber 33 from an oil reservoir 34. The latter is formed by the interior of the piston top 30 and the upper area of the piston bottom 31.

Oil can enter the oil reservoir 34 as a pressure means from the pressure means bore 9, shown in FIG. 7, via additional supply bores 35, 36, and 37. The spherical end section 10 is embodied at the end of the piston top 30 to contact the ball scraper 11. A lubricant channel 38 extends through the end section, via which oil exiting the oil reservoir 34 can reach the blind bore 21 of the ball scraper 11 and from there through the bore 23 acting as an oil ejection hole onto the running surface 24 of the roller 5.

The valve drive 39 according to the invention comprises components shown in FIGS. 1 through 6, namely a rocker arm 40, which is provided at one end 41 for contacting the valve shaft of a charge-cycle valve, and support elements 42, 43, each of which being provided with spherical end sections 44 and 45. A ball scraper 46 is embodied at the rocker arm 40 at its other end. With said ball scraper the rocker arm rests on the support element 42 via its spherical end section 44, or on the support element 43 via its spherical end section 45. A roller 47 is supported in a rotary fashion in the central area of the rocker arm 40, over which the cam of a cam shaft can roll. A bearing bolt 48 is fastened in the lateral walls 49 and 50 of the rocker arm 40 for the bearing of the roller 47.

The design of the support elements 42 and 43 is equivalent to that of the valve drives of prior art. They are embodied as valve clearance compensation elements, each comprising a housing 51 and a unit longitudinally displaceable therein. This unit forms an oil reservoir 54 together with a piston top 52 and a piston bottom 53. A ball valve 55 arranged at the lower end of the piston bottom 53 separates the oil reservoir 54 from the high-pressure chamber 56 of the valve clearance compensation element located underneath it, here forming the support element 42 and/or 43.

According to the invention, groove-shaped ventilation channels are arranged in the spherical end sections of the support elements, through which air can evacuate from the oil reservoir 54 of the support element. Here, at the support element 42 at the exterior surface of the spherical end section 44 two ventilation channels 57 are arranged extending in the radial direction, which start at a central lubrication channel 58 of the support element, while at the support element 43 at the exterior surface of the spherical end section 45 two ventilation channels 59 are arranged, starting at the respective lubrication channel 58, which extend in a helical (screw-like) direction.

Thus, based on the invention, air entrained in the lubrication and hydraulic oil can be guided out of the oil reservoir 54 of the respective support element 42 and/or 43 via its lubrication channel 58 and an adjacent blind bore 60 of the rocker lever-ball scraper 46, flowing into the ventilation channels 57 and/or 59, and guided thereby out of the valve drive.

| List of reference characters | |
|---|---|
| 1 | Valve drive |
| 2 | Cylinder head |
| 3 | Cam |
| 4 | Rocker arm |
| 5 | Roller |
| 6 | Support element |
| 7 | Charge-cycle valve |
| 8 | Accepting bore |
| 9 | Pressure means-bore |
| 10 | End section |
| 11 | Ball scraper |
| 12 | End |
| 13 | Valve shaft |
| 14 | Valve plate |
| 15 | Valve spring |
| 16 | Spring plate |
| 17 | Bolt |
| 18 | Lateral wall |
| 19 | Lateral wall |
| 20 | Needle bearing |
| 21 | Blind bore |
| 22 | Dome |
| 23 | Bore |
| 24 | Running surface |
| 25 | not applicable |
| 26 | not applicable |
| 27 | not applicable |
| 28 | Housing |
| 29 | Valve clearance compensation element |
| 30 | Piston top |
| 31 | Piston bottom |
| 32 | Ball valve |
| 33 | High-pressure chamber |
| 34 | Oil reservoir |
| 35 | Supply bore |
| 36 | Supply bore |
| 37 | Supply bore |
| 38 | Lubricant channel |
| 39 | Valve drive |
| 40 | Rocker arm |
| 41 | End |
| 42 | Support element |
| 43 | Support element |
| 44 | End section |
| 45 | End section |
| 46 | Ball scraper |
| 47 | Roller |
| 48 | Bearing bolt |
| 49 | Lateral wall |
| 50 | Lateral wall |
| 51 | Housing |
| 52 | Piston top |
| 53 | Piston bottom |
| 54 | Oil reservoir |
| 55 | Ball valve |
| 56 | High-pressure chamber |
| 57 | Ventilation channel |
| 58 | Lubricant channel |
| 59 | Ventilation channel |
| 60 | Blind bore |

What we claim is:

1. A valve drive for an internal combustion engine, with a rocker arm (40) being arranged in its cylinder head, pivotal by the cams of a cam shaft, and supported with one end (41) at the valve shaft of a charge-cycle valve, while it comprises a ball scraper (46) at its other end, which rests on the spherical end section (44, 45) of a support element (42, 43) embodied as a hydraulic valve clearance compensation element, characterized in that a groove shaped ventilation channel (57, 59) is arranged in the contact area between the ball scraper (46) of the rocker arm (40) and the spherical end section (44, 45) of the support element (42, 43), by which the oil reservoir (54) of the support element (42, 43) is open towards the outside;

wherein said groove shaped ventilation channel (57, 59) is connected to a central lubrication channel (58) in said support element (42, 43); and, wherein both oil and air are vented outside said spherical end section (44, 45) of said support element (42, 43) through said groove shaped ventilation channel (57, 59) and said central lubrication channel (58).

2. A valve drive according to claim 1, characterized in that the groove-shaped ventilation channel (57, 59) is arranged in the ball scraper (46) of the rocker arm (40).

3. A valve drive according to claim 2, characterized in that the groove-shaped ventilation channel is embodied as a recess arranged in an area of the rocker arm (40) deviating from the primary load area.

4. A valve drive according to claim 3, characterized in that several ventilation channels (57, 59) are arranged in the ball scraper (46) embodied as recesses.

5. A valve drive according to claim 2, characterized in that the ball scraper is embodied as a two-part scraper, which allows a lateral ventilation, namely ventilation off-set by 90° in reference to the level of the valve drive.

6. A valve drive according to claim 1, characterized in that the groove-shaped ventilation channel is arranged in the spherical end section (44, 45) of the support element (42, 43).

7. A valve drive according to claim 6, characterized in that the groove-shaped ventilation channel (57) is embodied as a recess, which extends in the spherical end section (44) in a circumferential direction with a component radial in reference to the longitudinal axis of the support element (42).

8. A valve drive according to claim 6, characterized in that the groove-shaped ventilation channel (59) is embodied as a recess, which is arranged in the spherical end section (45) of the support element (43) in a helical (screw-like) fashion.

9. A valve drive according to claim 7, characterized in that several ventilation channels (57, 59) embodied as recesses are arranged in the spherical end section (44, 45) of the support element (42, 43).

10. A valve drive according to claim 8, characterized in that several ventilation channels (57, 59) embodied as recesses are arranged in the spherical end section (44, 45) of the support element (42, 43).

* * * * *